US009816038B2

(12) United States Patent
Banerjee et al.

(10) Patent No.: US 9,816,038 B2
(45) Date of Patent: Nov. 14, 2017

(54) KEROSENE HYDROTREATING WITH A SEPARATE HIGH PRESSURE TRIM REACTOR

(71) Applicant: UOP LLC, Des Plaines, IL (US)

(72) Inventors: Soumendra M. Banerjee, New Delhi (IN); Peter Kokayeff, Naperville, IL (US); David A. Lindsay, Benicia, CA (US); Yoga R. Ayar, Buffalo Grove, IL (US)

(73) Assignee: UOP LLC, Des Plaines, IL (US)

( * ) Notice: Subject to any disclaimer, the term of this patent is extended or adjusted under 35 U.S.C. 154(b) by 247 days.

(21) Appl. No.: 14/302,714

(22) Filed: Jun. 12, 2014

(65) Prior Publication Data

US 2015/0361355 A1 Dec. 17, 2015

(51) Int. Cl.
*C10G 65/04* (2006.01)
*C10G 67/06* (2006.01)

(52) U.S. Cl.
CPC ..... *C10G 67/06* (2013.01); *C10G 65/04* (2013.01); *C10G 2300/1051* (2013.01)

(58) Field of Classification Search
CPC ..... C10G 45/22; C10G 65/06; C10G 65/04; C10G 65/02; C10G 65/00; C10G 67/06
See application file for complete search history.

(56) References Cited

U.S. PATENT DOCUMENTS

| | | | | |
|---|---|---|---|---|
| 4,036,745 | A * | 7/1977 | Broughton | C07C 7/13 208/310 Z |
| 4,648,959 | A * | 3/1987 | Herber | C10G 67/06 208/143 |
| 6,843,906 | B1 * | 1/2005 | Eng | C10G 45/02 208/208 R |
| 2006/0118466 | A1 * | 6/2006 | Galeazzi | C10G 7/00 208/210 |
| 2012/0130143 | A1 | 5/2012 | Van Doesburg | |
| 2012/0273394 | A1 | 11/2012 | Banerjee | |

OTHER PUBLICATIONS

Robinson, "Hydrotreating and Hydrocracking: Fundamentals", Practical Advances in Petroleum Processing, 2006, Springer New York, Print ISBN 978-0-387-25811-9, Online ISBN 978-0-387-25789-1, pp. 177-218.

Ranganathan, "Competing Reactions in Hydrotreating Coker Distillates from Athabasca Bitumen on Unpromoted and Promoted Catalysts", Energy Research Laboratories, Department of Energy, Mines & Resources, Ottawa, Ontario, Canada, pp. 159-174 , paper from Argonne Natl. Lab presentation May 8, 2013, Premium Coal Samples.

PCT International Search Report and Written Opinion dated Sep. 3, 2015 for PCT/US2015/031068.

* cited by examiner

*Primary Examiner* — Renee Robinson
*Assistant Examiner* — Derek Mueller

(57) ABSTRACT

A process is presented for the production of high quality kerosene from lower quality feedstocks, including kerosene produced from coker units, or kerosene from cracking units. The process includes hydrotreating the feedstock to remove contaminants in the feedstock. The hydrotreated process stream is then treated in a trim reactor at higher pressure to reduce the bromine index of the kerosene.

19 Claims, 1 Drawing Sheet

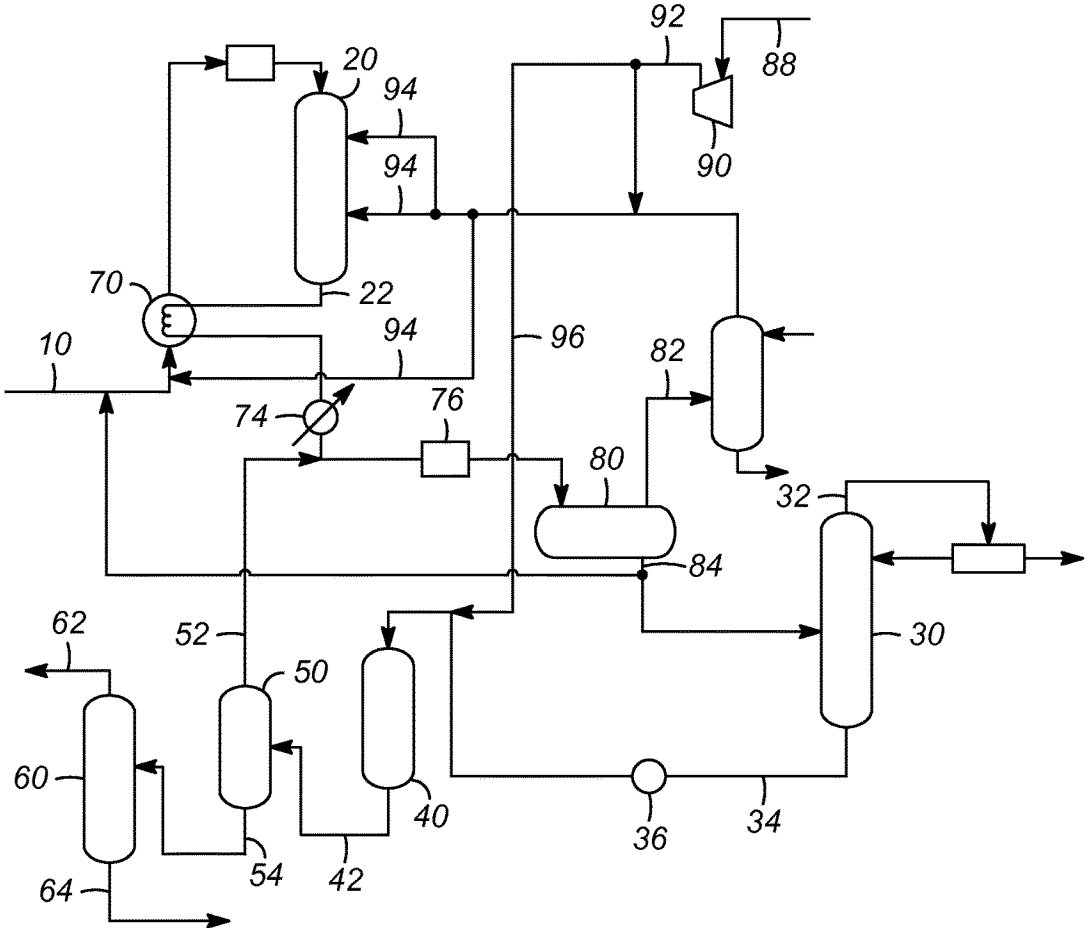
88
90
92
94
94
94
20
22
70
10
96
76
74
82
80
84
32
30
34
36
40
42
50
52
54
60
62
64

KEROSENE HYDROTREATING WITH A SEPARATE HIGH PRESSURE TRIM REACTOR

FIELD OF THE INVENTION

The field of the invention pertains to the production of high quality liquids from poorer hydrocarbon feedstocks. In particular, the process is for the conversion of low quality heavy hydrocarbons into higher quality kerosene feedstocks.

BACKGROUND

The demand for hydrocarbons remains a growth industry. The uses of hydrocarbons include the development of better fuels, as well as useful precursors for detergents, and for polymers.

In particular, the production of kerosene is important for numerous products, including motor fuels, and the production of detergents. The production of precursors for detergents includes the separation of a kerosene feedstock into a component comprising normal hydrocarbons and a component comprising non-normal hydrocarbons.

Kerosene range hydrocarbons can come from numerous sources, and as demand has increased, there has been an increase in usage of lower quality sources of hydrocarbons, such as petroleum coke.

Special commercial uses of normal paraffins require that the normal paraffins contain an especially low concentration of aromatics. By normal paraffins, it is meant straight-chain, linear or unbranched paraffins. One of these special uses is the manufacture of detergents made from alkylbenzenes, in which C9 to C22 normal paraffins are dehydrogenated to olefins that are then used to alkylate benzene. The problems with aromatics in the normal paraffins, particularly aromatics having the same carbon number as the normal paraffins, arise during the alkylation step because of the occurrence of two side-reactions: first, the ring of the aromatic can react with an olefin to produce a heavy, dialkyl benzene by-product, and second the side-chain of the aromatic can be dehydrogenated and react with benzene to produce a heavy, biphenyl by-product. Either by-product is not suitable for detergents. These side-reactions result in waste of valuable feedstocks, costs for separation and disposal of by-products, and economic loss. For these reasons, there is sometimes a preference that the concentration of aromatics in normal paraffins used for commercial production of detergents be less than 0.005 wt-% (50 wppm) of the normal paraffins.

The most plentiful, commercial source of C9 to C22 normal paraffins is crude oil, in particular the kerosene-range fraction. By "kerosene-range" is meant the boiling point range of 360° F.-530° F. (182° C.-277° C.). This fraction is a complex mixture comprising normal paraffins, iso-paraffins, and aromatics from which the normal paraffins cannot be separated using conventional distillation. Depending on the type of crude from which the hydrocarbon fraction is derived and the carbon number range of the fraction, the concentration of normal paraffins is usually 15-60 wt-% of the feed and the concentration of aromatics is usually 10-30 wt-% of the feed. There may be more unusual feed streams which have aromatic concentrations of only 2-4 wt-% of the feed.

The separation of various hydrocarbonaceous compounds through the use of selective sorbents is widespread in the petroleum, chemical and petrochemical industries. Sorption is often utilized when it is more difficult or expensive to separate the same compounds by other means such as fractionation. Examples of the types of separations which are often performed using selective sorbents include the separation of para-xylene from a mixture of xylenes, unsaturated fatty acids from saturated fatty acids, fructose from glucose, acyclic olefins from acyclic paraffins, and normal paraffins from isoparaffins. Typically, the selectively sorbed materials have the same number of carbon atoms per molecule as the non-selectively adsorbed materials and very similar boiling points. Another common application is the recovery of a particular class of hydrocarbons from a broad boiling point range mixture of two or more classes of hydrocarbons. An example is the separation of C10 to C14 normal paraffins from a mixture which also contains C10 to C14 iso-paraffins.

One of the principal prior art processes for the selective removal of the aromatics from the kerosene-range fraction employs a sorption process that separates the normal paraffins and the iso-paraffins. The sorbent used in this process has pores which the normal paraffins can enter, but which the aromatics, like the iso-paraffins, cannot enter because their cross-sectional diameter is too great. Contacting a kerosene-range feed with the sorbent produces a raffinate stream containing almost all of the iso-paraffins and aromatics that were in the feed, and a sorbent loaded with sorbed normal paraffins. Then, contacting the loaded sorbent with a desorbent stream produces an extract product containing almost all of the normal paraffins in the feed. But, sorbents used in this process are not ideally selective for normal paraffins, and where the sorbent comprises a crystalline zeolite and an amorphous binder, the binder itself may be selective for aromatics. Consequently, a small portion of the feed aromatics is rather tenaciously sorbed on the surfaces of the sorbent and ultimately appears as a contaminant in the extract (normal paraffin) product. With a typical kerosene-range feed and a commercial sorbent, the concentration of aromatics is usually 0.15-0.50 wt-% (1500-5000 wppm) of the extract product, which is sometimes unacceptably high for production of commercial detergents.

The use of lower quality sources of heavy hydrocarbons requires the processing of that hydrocarbon to allow its usage in today's industries.

SUMMARY

The present invention is a process for treating kerosene range hydrocarbons to reduce contaminants and to meet specifications of kerosene for downstream processing. This includes preparing the kerosene to protect downstream adsorbents. The process includes passing a first stream comprising kerosene range hydrocarbons to a hydrotreating reaction zone to generate a hydrotreated kerosene stream. The process further includes passing the hydrotreated kerosene stream to a separation process to generate a light overhead stream, and a bottoms stream comprising hydrotreated kerosene; and then passing the bottoms stream to a trim reactor at an elevated pressure to generate a second stream comprising treated kerosene.

An embodiment of the present invention is a process for hydrotreating a hydrocarbon stream having hydrocarbons in the C9 to C22 range. The process includes heating the hydrocarbon stream to generate a heated stream and passing the heated stream to a hydrotreating reactor to generate a hydrotreated stream. The hydrotreated stream is cooled to generate a cooled hydrotreated stream, which is then separated in a cold separator to generate a vapor stream and a liquid stream comprising kerosene. The liquid stream is passed to a stripping unit to generate an overhead stream and a bottoms stream comprising kerosene. The bottoms stream is pressurized to generate a pressurized stream to be fed to a trim reactor that is operated at an elevated pressure to generate a process stream with reduced contaminants.

Other objects, advantages and applications of the present invention will become apparent to those skilled in the art from the following detailed description and drawings.

BRIEF DESCRIPTION OF THE DRAWING

FIGURE is a schematic of the process of the present invention for generating a treated kerosene stream with a low bromine index.

DETAILED DESCRIPTION OF THE INVENTION

Refiners are keen to upgrade low value sources of kerosene to high value feedstock like normal paraffins. Many low value kerosene sources, including coker kerosene, contain high levels of Sulfur (S) and Nitrogen (N) it has to be hydrotreated to reduce the levels of S and N before it can be treated in a separation unit like an adsorption separation unit to separate the normal paraffins (NP) from non-normal hydrocarbons. Other sources of kerosene range hydrocarbons, or hydrocarbons having 9 to 22 carbon atoms, include cracked kerosene from slurry hydrocracking and from thermal and catalytic cracking units. Feed specifications for an adsorption separation unit require severe hydrotreating to reduce the S to less than 1 wppm and Nitrogen to 0.5 wppm (maximum). A source, such as coker kerosene also contains olefins and diolefins and during the hydrotreating process these get saturated increasing the NP yield. One of the feed specification to an adsorption separation unit is that the Bromine Index (BI) of the feed should be in the range of 50-100 for to ensure a longer life of the adsorbent. In order to meet all three specifications of S, N and BI, hydrotreating at pressures of 7.5 to 8.4 MPa (absolute) (1100-1200 psig) is required.

It is preferable to hydrotreat at the lowest possible pressure to reduce the cost of processing, and to reduce the capital cost, thereby allowing for a shorter payback on the investment. While it is possible to meet the Sulfur and Nitrogen specifications at a relatively lower pressure of 700-900 psig, the problem is to get the desired BI for the product. Normally a post treat reactor, loaded with a hydrotreating catalyst, is required to be installed downstream of the main Hydrotreating reactor to achieve the BI specification. The post treat reactor has to operate at sufficiently high pressure and catalyst volume to meet the BI. Also due to equilibrium limitations the temperature of the post treat reactor should be in the range of 250-300° C. to ensure the required olefins saturation is obtained to meet the required BI limits.

However even with the post treat reactor it is not possible to achieve low BI values of 50-100. In the current invention the post treat reactor is eliminated and a trim reactor is used downstream of product stripping. A trim reactor is a reactor for operation at higher pressure conditions. This trim reactor uses a noble metal catalyst to effectively reduce the BI of the stripped product in the 50-100 range. And there is no indication of in the prior art of using the combination of a hydrotreating reactor with a high pressure trim reactor operating on a clean feed to reduce the bromine index.

The present invention is for treating kerosene range hydrocarbons. The process as shown in the FIGURE, includes passing a first stream 10 comprising kerosene range hydrocarbons to a hydrotreating reaction zone 20 to generate a hydrotreated kerosene stream 22. The hydrotreated kerosene stream is passed to a separation process 30 to generate a light overhead stream 32 and a bottoms stream 34 comprising hydrotreated kerosene. The bottoms stream 34 is passed to a trim reactor 40 to generate a second stream 42 comprising treated kerosene. The bottoms stream 34 is passed through a pump 36 to raise the pressure to the trim reactor 40 pressure.

In one embodiment, the second stream 42 is passed to a flash drum 50 to generate a vapor stream 52 comprising light components generated in the trim reactor 50 and hydrogen. The flash drum also creates a third stream 54 comprising the treated kerosene. The third stream 54 is passed to a low pressure stripping unit 60 to further strip light gases 62 and to generate a fourth stream comprising the clean and treated kerosene 64. The low pressure stripping unit 60 is operated at very low pressures from about 150 to about 170 kPa (absolute).

The treated kerosene 64 can now be used for downstream processing. In one embodiment, the treated kerosene is passed to an adsorption separation unit to generate an extract stream comprising normal paraffins and a raffinate stream comprising non-normal hydrocarbons. The normal paraffins can be used in the manufacture of detergents and surfactants.

One aspect of the process is precooling of the hydrotreated kerosene stream 22 before passing the stream to the separation process 30. The hydrotreated kerosene stream 22 is passed through a heat exchanger 70 to generate a cooled hydrotreated stream 72, while preheating the first stream 10. The cooled hydrotreated stream 72 can be further cooled with additional heat exchangers 74, 76, before passing to a cold separator 80. The cold separator 80 separates a vapor stream 82 comprising light gases, including hydrogen, and a liquid stream 84. The liquid stream 84 is passed to the separation unit 30. In one embodiment, the separation unit 30 is a stripper to separate lighter naphtha components from the kerosene components. The stripper 30 generates an overhead stream 32 comprising naphtha range hydrocarbons, and a bottoms stream 34 comprising the treated kerosene.

The hydrotreating reaction zone 20 can comprise a plurality of fixed reaction beds, with additional inlets for the recycle streams and hydrogen, or can comprise a plurality of hydrotreating reactors linked serially with inlets for passing hydrogen. The hydrotreating reaction zone 20 is operated at hydrotreating reaction conditions that include a reaction temperature between 270° C. and 290° C., and a reaction pressure between 1 and 4.2 MPa (absolute).

The trim reactor 40 is used to hydrotreat the treated kerosene to reduce the olefin and diolefin content of the treated kerosene. The trim reactor is operated at a trim reaction set of conditions that include a temperature between 150° C. and 200° C., and the feed to the trim reactor will be heat exchanged to bring the feed to the desired temperature range. The trim reactor liquid hour space velocity will be operated between 10 and 20 $hr^{-1}$. The treated kerosene stream 34 is pumped to the trim reactor pressure, which is at least 140 kPa above the pressure of the hydrotreating reaction zone, and preferably in the range of 140 to 210 kPa above the pressure in the hydrotreating reaction zone. It is preferable to treat the kerosene at a relatively low pressure in the hydrotreating reactor, then separating out a relatively purer kerosene stream and further reacting the kerosene in a smaller reactor at higher pressure for improving the bromine index.

Hydrogen is used in the hydrotreating process, and is added to the feedstreams to the hydrotreating zone and to the trim reactor. A hydrogen feedstream 88 is passed to a compressor 90 to generate a compressed hydrogen stream 92. The compressed hydrogen stream 92 can be split and portions 94 fed at different stages of the hydrotreating zone 20. A smaller portion 96 is combined with the trim reactor feed 34. Hydrogen is passed to the hydrotreating reactor for kerosene at about 80 m3 (at standard temperatures and pressures) perm3 of kerosene treated. This hydrogen includes recycled hydrogen, as only a portion is used up, and needs to be replaced with make-up hydrogen. The portion of hydrogen for the trim reactor is relatively small, and is in the range of 1.5 to 3.5 m3/m3. Hydrogen not consumed in the trim reactor 40 will be recovered in the flash drum 50 and recycled.

The hydrotreating reaction includes a catalyst in the reaction zone to carry out the reaction. A hydrotreating catalyst includes a metal on a support. The metals used in hydrotreating includes molybdenum (Mo), tungsten (W), cobalt (Co), and nickel (Ni). The catalysts can include one or more of the metals. Supports include aluminas, silicas, zeolites, refractory materials, and the like. The reaction zone comprises a plurality of fixed beds, and the fixed bed reactors can include trickle bed reactors.

The trim reactor includes a catalyst for hydrogenating olefins, diolefins and acetylenes. The trim reactor catalyst includes a metal on a support, wherein the metal is a noble metal. Preferred noble metals include palladium (Pd) and platinum (Pt), silver (Ag), and gold (Au) or a mixture of these metals.

While hydrotreating conditions can span a broad range of temperatures and pressures, the conditions are also dependent upon the hydrocarbon that is to be hydrotreated. In general, the higher the temperatures and pressures. As shown in the Table showing typical process conditions, kerosene is typically hydrotreated at a temperature around 290° C. and a pressure between 1.8 and 4 MPa (absolute). Going to higher temperatures and pressures for normal hydrotreating can result in undesired side reactions, such as thermal cracking.

TABLE

Typical Hydrotreating Process Conditions for Different Petroleum Fractions

| | Naphtha | Kerosene | Diesel | VGO | Residue |
|---|---|---|---|---|---|
| WART (° C.) | 270-280 | 280-290 | 300-315 | 360-370 | 370-390 |
| H2 pressure (MPa abs) | 1.8-3.2 | 1.8-4.2 | 4.2-5.6 | 5.6-13.9 | >13.9 |
| LHSV | 5 | 4 | 2-3 | 0.8-1.5 | 0.5 |
| H2/oil ratio (m3/m3) | 60 | 80 | 140 | 210 | >520 |

WART—weighted average reactor temperature
LHSV—liquid hourly space velocity

SPECIFIC EMBODIMENTS

While the following is described in conjunction with specific embodiments, it will be understood that this description is intended to illustrate and not limit the scope of the preceding description and the appended claims.

A first embodiment of the invention is a process for treating kerosene range hydrocarbons, comprising passing a first stream comprising kerosene range hydrocarbons to a hydrotreating reaction zone to generate a hydrotreated kerosene stream; passing the hydrotreated kerosene stream to a separation process to generate a light overhead stream, and a bottoms stream comprising hydrotreated kerosene; and passing the bottoms stream to a trim reactor at an elevated pressure to generate a second stream comprising treated kerosene. An embodiment of the invention is one, any or all of prior embodiments in this paragraph up through the first embodiment in this paragraph wherein the bottoms stream is pressurized through a pump to the trim reactor pressure. An embodiment of the invention is one, any or all of prior embodiments in this paragraph up through the first embodiment in this paragraph further comprising passing the second stream to a flash drum to generate a vapor stream and a third stream comprising kerosene. An embodiment of the invention is one, any or all of prior embodiments in this paragraph up through the first embodiment in this paragraph further comprising passing the third stream to a low pressure stripping unit to generate a low pressure overhead stream, and a fourth stream comprising kerosene. An embodiment of the invention is one, any or all of prior embodiments in this paragraph up through the first embodiment in this paragraph further comprising passing the fourth stream to an adsorption separation unit to generate an extract stream comprising normal paraffins and a raffinate stream comprising non-normal paraffins. An embodiment of the invention is one, any or all of prior embodiments in this paragraph up through the first embodiment in this paragraph wherein the separation process comprises cooling the hydrotreated kerosene stream to generate a cooled hydrotreated kerosene stream; passing the cooled hydrotreated kerosene stream to a cold separator to generate a vapor stream comprising light gases and a liquid stream; and passing the liquid stream to a stripper to generate an overhead stream comprising lighter hydrocarbons, and the bottoms stream comprising hydrotreated kerosene. An embodiment of the invention is one, any or all of prior embodiments in this paragraph up through the first embodiment in this paragraph wherein the hydrotreating reaction zone is operated at a temperature between 270° C. and 290° C. An embodiment of the invention is one, any or all of prior embodiments in this paragraph up through the first embodiment in this paragraph wherein the hydrotreating reaction zone is operated at a pressure between 1 and 2 MPa. An embodiment of the invention is one, any or all of prior embodiments in this paragraph up through the first embodiment in this paragraph wherein the trim reactor is operated at a temperature between 150 and 200 C. An embodiment of the invention is one, any or all of prior embodiments in this paragraph up through the first embodiment in this paragraph wherein the trim reactor is operated at a pressure at least 140 kPa above the pressure of the hydrotreating reaction zone. An embodiment of the invention is one, any or all of prior embodiments in this paragraph up through the first embodiment in this paragraph wherein the hydrotreating reaction zone comprises a plurality of fixed hydrotreating reactor beds. An embodiment of the invention is one, any or all of prior embodiments in this paragraph up through the first embodiment in this paragraph wherein the hydrotreating reaction zone comprises a plurality of hydrotreating reactors. An embodiment of the invention is one, any or all of prior embodiments in this paragraph up through the first embodiment in this paragraph wherein the hydrotreating reaction zone includes a catalyst comprising a metal on a support, wherein the metal is selected from the group consisting of Mo, W, Co, Ni, and mixtures thereof. An embodiment of the invention is one, any or all of prior embodiments in this paragraph up through the first embodiment in this paragraph wherein the trim reactor includes a catalyst comprising a metal on a support, wherein the metal is selected from the group consisting of Pd, Pt and mixtures thereof.

A second embodiment of the invention is a process for hydrotreating a hydrocarbon stream having hydrocarbons in the C9 to C22 range, comprising heating the hydrocarbon stream to generate a heated stream; passing the heated stream to a hydrotreating reactor to generate a hydrotreated stream; cooling the hydrotreated stream to generate a cooled hydrotreated stream; separating the cooled hydrotreated stream in a cold separator to generate a vapor stream and a liquid stream comprising kerosene; passing the liquid stream to a stripping unit to generate an overhead stream and a bottoms stream comprising kerosene; pressurizing the bottoms stream to generate a pressurized stream; and passing the pressurized stream to a trim reactor to generate a process stream with reduced contaminants. An embodiment of the invention is one, any or all of prior embodiments in this paragraph up through the second embodiment in this paragraph wherein the hydrotreating reactor includes a catalyst comprising a metal on a support, wherein the metal is selected from the group consisting of Mo, W, Co, Ni, and mixtures thereof. An embodiment of the invention is one, any or all of prior embodiments in this paragraph up through the second embodiment in this paragraph wherein the trim reactor includes a catalyst comprising a metal on a support, wherein the metal is selected from the group consisting of Pd, Pt, Ag, Au, and mixtures thereof. An embodiment of the invention is one, any or all of prior embodiments in this paragraph up through the second embodiment in this paragraph wherein the vapor stream from the cold separator comprises hydrogen, and further comprises passing a portion of the vapor stream to the hydrotreating reactor. An embodiment of the invention is one, any or all of prior embodiments in this paragraph up through the second embodiment in this paragraph further comprising compressing a hydrogen gas stream to generate a compressed hydrogen stream; and passing the compressed hydrogen stream to the trim reactor. An embodiment of the invention is one, any or all of prior embodiments in this paragraph up through the second embodiment in this paragraph further comprising passing the process stream to a flash drum to generate a low pressure vapor, and a low pressure liquid stream; passing the low pressure liquid stream to a low pressure stripper to generate a low pressure overhead oil, and a kerosene product stream; and passing the kerosene product stream to an adsorption separation unit to generate an extract stream comprising normal paraffins, and a raffinate stream comprising non-normal hydrocarbons.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

What is claimed is:

1. A process for treating kerosene range hydrocarbons for an adsorption separation process, comprising:

passing a first stream comprising kerosene range hydrocarbons to a hydrotreating reaction zone to generate a hydrotreated kerosene stream;

passing the hydrotreated kerosene stream to a separation process to generate a light overhead stream, and a bottoms stream comprising hydrotreated kerosene; and passing the bottoms stream to a trim reactor operated at an elevated pressure to generate a second stream comprising treated kerosene, wherein the elevated pressure is a pressure in the range of about 140 to about 210 kPa above the pressure of the hydrotreating reaction zone, and to reduce the bromine index below 100.

2. The process of claim 1 wherein the bottoms stream is pressurized through a pump to the trim reactor pressure.

3. The process of claim 1 further comprising passing the second stream to a flash drum to generate a vapor stream and a third stream comprising kerosene.

4. The process of claim 3 further comprising passing the third stream to a low pressure stripping unit to generate a low pressure overhead stream, and a fourth stream comprising kerosene.

5. The process of claim 4 further comprising passing the fourth stream to an adsorption separation unit to generate an extract stream comprising normal paraffins and a raffinate stream comprising non-normal paraffins.

6. The process of claim 1 wherein the separation process comprises:

cooling the hydrotreated kerosene stream to generate a cooled hydrotreated kerosene stream;

passing the cooled hydrotreated kerosene stream to a cold separator to generate a vapor stream comprising light gases and a liquid stream; and passing the liquid stream to a stripper to generate an overhead stream comprising lighter hydrocarbons, and the bottoms stream comprising hydrotreated kerosene.

7. The process of claim 1 wherein the hydrotreating reaction zone is operated at a temperature between 270° C. and 290° C.

8. The process of claim 1 wherein the hydrotreating reaction zone is operated at a pressure between 1 and 4.2 MPa.

9. The process of claim 1 wherein the trim reactor is operated at a temperature between 150° C. and 200° C.

10. The process of claim 1 wherein the hydrotreating reaction zone comprises a plurality of fixed hydrotreating reactor beds.

11. The process of claim 1 wherein the hydrotreating reaction zone comprises a plurality of hydrotreating reactors.

12. The process of claim 1 wherein the hydrotreating reaction zone includes a catalyst comprising a metal on a support, wherein the metal is selected from the group consisting of Mo, W, Co, Ni, and mixtures thereof.

13. The process of claim 1 wherein the trim reactor includes a catalyst comprising a metal on a support, wherein the metal is selected from the group consisting of Pd, Pt and mixtures thereof.

14. A process for hydrotreating a hydrocarbon stream having hydrocarbons in the $C_9$ to $C_{22}$ range for an adsorption separation process, comprising:

heating the hydrocarbon stream to generate a heated stream;

passing the heated stream to a hydrotreating reactor to generate a hydrotreated stream;

cooling the hydrotreated stream to generate a cooled hydrotreated stream;

separating the cooled hydrotreated stream in a cold separator to generate a vapor stream and a liquid stream comprising kerosene;

passing the liquid stream to a stripping unit to generate an overhead stream and a bottoms stream comprising kerosene;

pressurizing the bottoms stream to generate a pressurized stream; and passing the pressurized stream to a trim reactor, operated at an elevated pressure in the range of about 140 to about 210 kPa above the pressure of the hydrotreating reaction zone to reduce the bromine index to below 100, and to generate a process stream with reduced contaminants.

15. The process of claim 14 wherein the hydrotreating reactor includes a catalyst comprising a metal on a support, wherein the metal is selected from the group consisting of Mo, W, Co, Ni, and mixtures thereof.

16. The process of claim 14 wherein the trim reactor includes a catalyst comprising a metal on a support, wherein the metal is selected from the group consisting of Pd, Pt, Ag, Au, and mixtures thereof.

17. The process of claim 14 wherein the vapor stream from the cold separator comprises hydrogen, and further comprises passing a portion of the vapor stream to the hydrotreating reactor.

18. The process of claim 14 further comprising:

compressing a hydrogen gas stream to generate a compressed hydrogen stream; and passing the compressed hydrogen stream to the trim reactor.

19. The process of claim 14 further comprising:

passing the process stream to a flash drum to generate a low pressure vapor, and a low pressure liquid stream;

passing the low pressure liquid stream to a low pressure stripper to generate a low pressure overhead oil, and a kerosene product stream; and passing the kerosene product stream to an adsorption separation unit to generate an extract stream comprising normal paraffins, and a raffinate stream comprising non-normal hydrocarbons.

* * * * *